US010064246B2

(12) United States Patent
Reischmann et al.

(10) Patent No.: US 10,064,246 B2
(45) Date of Patent: Aug. 28, 2018

(54) INDUCTION COOK-TOP APPARATUS

(71) Applicants: Michael Reischmann, Eustis, FL (US); Phillip Williams, Clinton, CT (US)

(72) Inventors: Michael Reischmann, Eustis, FL (US); Phillip Williams, Clinton, CT (US)

(73) Assignee: Kenyon International, Inc., Clinton, CT (US)

( * ) Notice: Subject to any disclaimer, the term of this patent is extended or adjusted under 35 U.S.C. 154(b) by 12 days.

(21) Appl. No.: 14/843,436

(22) Filed: Sep. 2, 2015

(65) Prior Publication Data

US 2015/0382407 A1 Dec. 31, 2015

Related U.S. Application Data

(63) Continuation of application No. PCT/US2013/022470, filed on Jan. 22, 2013, which is a continuation of application No. 13/359,156, filed on Jan. 26, 2012, now Pat. No. 9,095,005, which is a continuation-in-part of application No. 12/468,591, filed on May 19, 2009, now Pat. No. 8,766,147.

(60) Provisional application No. 61/080,858, filed on Jul. 15, 2008, provisional application No. 61/054,693, filed on May 20, 2008.

(51) Int. Cl.
*H05B 6/12* (2006.01)

(52) U.S. Cl.
CPC ..... *H05B 6/1209* (2013.01)

(58) Field of Classification Search
CPC ..... H05B 6/1209; H05B 6/062; H05B 6/101; H05B 6/02
USPC ..... 219/620, 622, 624, 626, 665, 676, 219/452.11, 460.1, 443.1, 452.12; 84/385 P
See application file for complete search history.

(56) References Cited

U.S. PATENT DOCUMENTS 1,992,515 A 2/1935 Uhimann
2,582,449 A * 1/1952 Millar ..... A47C 7/34 118/419
3,231,718 A * 1/1966 Vasile ..... A47J 36/2483 156/224
3,612,828 A * 10/1971 Siegla ..... H05B 3/748 219/452.12

(Continued)

FOREIGN PATENT DOCUMENTS

DE 3810253 A1 10/1988
DE 202006014738 U1 12/2006

(Continued)

OTHER PUBLICATIONS

Daorae Korean BBQ Restaurant—Korean BBQ in Desa Sri Hartamas; Retrieved from the internet on Jul. 27, 2011; http://feedmah.com/blog/daorae-korean-bbq-restaurant-korean-bbq-in-desa-sri-hartamas/; 5 pages.

(Continued)

*Primary Examiner* — Jimmy Chou
(74) *Attorney, Agent, or Firm* — St. Onge Steward Johnston & Reens, LLC

(57) ABSTRACT

An induction stove assembly that utilizes pads between the cook-top of the stove and cooking vessels placed on the stove for heating. The pads are easily removable and interchangeable with other similar pads. The pads help protect the cook-top from damage, make clean-up more efficient, and insulate the cook-top from excessive heating.

16 Claims, 8 Drawing Sheets

(56) References Cited

U.S. PATENT DOCUMENTS 3,624,352 A * 11/1971 Deaton ..... H05B 3/748 126/39 J
3,636,309 A * 1/1972 Deaton ..... H05B 3/746 219/446.1
3,646,321 A * 2/1972 Siegla ..... F24C 15/102 219/465.1
3,679,870 A * 7/1972 Opp ..... F24C 15/105 219/446.1
3,715,550 A * 2/1973 Harnden, Jr. ..... H05B 6/062 126/39 J
3,733,462 A * 5/1973 Bouchard ..... F24C 7/067 219/452.12
3,734,077 A * 5/1973 Murdough ..... A47J 36/2494 126/246
3,742,179 A * 6/1973 Harnden, Jr. ..... H05B 6/062 219/501
3,767,506 A * 10/1973 Kawakami ..... G10D 9/043 156/293
3,777,094 A 12/1973 Peters, Jr.
3,786,220 A 1/1974 Harnden, Jr.
3,836,744 A 9/1974 Taketo et al.
3,898,410 A * 8/1975 Peters, Jr. ..... H02M 5/45 219/622
3,974,358 A * 8/1976 Goltsos ..... A47J 39/02 206/541
4,110,587 A * 8/1978 Souder, Jr. ..... A47J 39/006 219/386
4,151,387 A 4/1979 Peters, Jr.
4,158,979 A * 6/1979 Suzuki ..... G10D 9/043 84/385 P
4,348,571 A 9/1982 Dills
4,447,710 A * 5/1984 McWilliams ..... H05B 1/0266 219/448.14
4,508,961 A * 4/1985 McWilliams ..... H05B 3/746 219/448.11
4,517,446 A * 5/1985 Torning ..... A47J 39/006 219/386
4,704,939 A * 11/1987 Straubinger ..... G10D 9/043 84/385 P
4,790,292 A 12/1988 Kuhn
4,910,372 A 3/1990 Vukich
4,914,717 A * 4/1990 Gibbon ..... A61F 7/02 219/679
4,967,632 A * 11/1990 Etheredge ..... G10D 9/043 84/385 P
5,183,954 A * 2/1993 Wasser ..... G10D 9/043 84/385 P
5,183,996 A 2/1993 Hazan et al.
5,430,273 A 7/1995 Bogdanski et al.
5,448,038 A * 9/1995 Kim ..... H05B 1/0266 219/441
5,508,498 A * 4/1996 Rheinish ..... A47G 21/02 219/730
5,634,256 A * 6/1997 Fritschi ..... A47J 41/028 215/12.1
5,640,947 A 6/1997 Shute
5,954,984 A 9/1999 Ablah
5,958,272 A 9/1999 Taplan et al.
5,973,303 A 10/1999 Kuse
6,028,256 A * 2/2000 Straubinger ..... G10D 9/043 84/380 R
6,121,591 A 9/2000 Eskildsen
6,188,047 B1 * 2/2001 White ..... H05B 3/74 219/460.1
6,284,958 B1 * 9/2001 Aoki ..... G10D 9/043 84/385 P
6,310,329 B1 10/2001 Carter
6,344,604 B1 * 2/2002 Schmidt ..... G10D 9/043 84/385 P
6,483,087 B2 * 11/2002 Gardner ..... B29C 70/82 219/529
6,657,170 B2 * 12/2003 Clothier ..... A47C 1/12 126/400
6,664,455 B2 * 12/2003 Aoki ..... G10D 9/043 84/385 A
6,840,167 B2 * 1/2005 Clark ..... B41F 17/001 101/327
6,972,361 B2 * 12/2005 Shibamiya ..... G10D 9/043 84/385 P
6,989,517 B2 1/2006 Owens et al.
7,081,603 B2 7/2006 Hoh et al.
7,173,224 B2 2/2007 Kataoka et al.
7,459,621 B2 * 12/2008 Straubinger ..... G10D 9/043 84/385 P
7,468,479 B2 * 12/2008 Kraus ..... G10D 9/043 84/385 P
2002/0051695 A1 * 5/2002 Friederich ..... F16B 25/00 411/424
2002/0063124 A1 5/2002 Clothier et al.
2003/0070531 A1 * 4/2003 Aoki ..... G10D 9/043 84/385 P
2003/0116560 A1 6/2003 Wyatt
2004/0139860 A1 * 7/2004 Hamm ..... A47J 36/2433 99/275
2005/0205561 A1 * 9/2005 Keishima ..... H05B 6/1209 219/621
2006/0081615 A1 * 4/2006 Kataoka ..... H05B 6/062 219/622
2006/0102013 A1 * 5/2006 Spohn ..... A21B 3/15 99/422
2006/0191908 A1 * 8/2006 Park ..... H01L 23/3672 219/622
2007/0039875 A1 * 2/2007 Solomon-Winnemore ..... B01J 20/28023 210/502.1
2007/0082164 A1 4/2007 Sellers
2007/0173595 A1 * 7/2007 Tsuji ..... C08K 3/22 524/588
2009/0095736 A1 4/2009 Graber et al.
2009/0289054 A1 11/2009 Williams et al.
2013/0043231 A1 * 2/2013 Won ..... B60H 1/2218 219/202

FOREIGN PATENT DOCUMENTS

EP 1489479 A1 12/2004
EP 1492386 A1 12/2004
GB 2338778 A 12/1999
JP 1200589 A 8/1989
JP H05226069 A 9/1993
JP 2005174705 A 6/2005
JP 2005216844 A 8/2005
JP 2008166088 A 7/2008
JP 3174629 U 3/2012
WO 0205596 A1 1/2002

OTHER PUBLICATIONS

European Search Report Application No. EP 09 75 1427 Completed: Nov. 2, 2013 8 pages.
TheInductionSite.com. "Induction Cooking: Useful Accessories" [Online Article] available since Feb. 22, 2010; Accessed Mar. 19, 2013; 7 pages.
International Search Report and Written Opinion of the International Searching Authority Application No. PCT/US2013/022470 Completed: Mar. 19, 2013; dated Apr. 5, 2013 7 pages.
International Search Report and Written Opinion of the International Searching Authority; PCT/US09/44593; dated Jul. 1, 2009; 9 pages.
Korean Barbecue Dos and Don'ts—retrieved from the internet on Jul. 27, 2011; http://www.thefoodsection.com/foodsection/2005/4/korean_barbecue.html; 8 pages.
Certification Statement from Park IP Translations; Signed by: Abraham I. Holczer: Signature Date: Nov. 21, 2011; 1 page.

(56) References Cited

OTHER PUBLICATIONS

Translation of Unexamined Japanese Application Publication No. JP H01-200589; Published Aug. 11, 1989; Translation Issued Nov. 21, 2011; 11 pages. Translated by Park IP Translations.

* cited by examiner

INDUCTION COOK-TOP APPARATUS

FIELD OF THE INVENTION

The present invention relates to induction stoves. More particularly, the present invention relates to induction stove assemblies having improved safety and convenience and devices for improving the safety and convenience of an induction stove.

BACKGROUND OF THE INVENTION

Induction stoves have been known for decades but have gained popularity in recent years due to their many advantages over other types of stoves. Like a traditional electric stove, an induction stove uses electricity to generate heat. However, instead of heating a resistive element (such as a coil of metal) by passing electric current through it, an induction stove generates an oscillating magnetic field that causes the cooking vessel itself to be heated. The term "cooking vessel," as used throughout this specification, refers to any pot, pan, skillet or other article in which food or other material is placed to be heated on a stove.

In an induction stove, a wire coil located beneath the cook-top receives an alternating electrical current, and thereby creates an oscillating magnetic field. When a cooking vessel made from a ferromagnetic material is placed on the cook-top, the oscillating magnetic field causes the ferromagnetic material to heat up. The ferromagnetic material is heated by means of magnetic hysteresis loss in the ferromagnetic material as well as by eddy currents created in the ferromagnetic material (which generate heat due to the electrical resistance of the material). The mechanisms by which an induction stove generates heat in a cooking vessel are well known to those of skill in the art. Typically, no portion of the cook-top itself is directly heated by the induction heating element, unlike in a traditional electric stove, where a circular heating element is heated in order to heat a cooking vessel that is placed thereon.

One advantage of induction stoves is that the cook-top surface is often formed of a smooth, ceramic glass material that is easy to clean and has a pleasing appearance. Gas stoves are often much more difficult to clean because of the need to have deep recesses for the grates on which cooking vessels are placed and protrusions for the gas outlets.

Additionally, the fact that no portion of an induction cook-top itself is directly heated provides a safety benefit over a traditional electric stove. As is well known, the heating element of a traditional electric stove remains dangerously hot for a long period after the stove is turned off. This residual and unwanted heat poses a clear safety hazard, which can be largely overcome by induction stoves.

Unfortunately, prior art induction stoves, while possessing many advantages over traditional gas and electric stoves, still suffer from notable drawbacks. In many prior art induction stoves, the ceramic glass cook-top surface, while pleasing to look at, is sometimes susceptible to scratches in the areas of the cook-top in which cooking vessels are placed during use. Cooking vessels used for induction cooking include those constructed from cast iron, carbon steel, and some stainless steels—which materials can sometimes have rough surfaces and/or corners that can scratch ceramic glass. Also, very heavy cooking vessels (such as those made from cast iron) may crack or break the cook-top if they are mishandled or dropped on the cook-top.

Additionally, it is sometimes undesirable to clean the cook-top itself. For example, the cook-top may retain some residual heat from the cooking, or the cook-top may be susceptible to damage from a particularly abrasive cleaning product. Or, if a plurality of induction stoves are installed in a hotel or dormitory, cleaning all of the cook-tops by hand may be an inefficient use of time. In such circumstances, it may not be desirable to clean the cook-top.

Further, the benefit of not directly heating any part of the cook-top can be noticeably reduced as a result of the transfer of heat from the cooking vessel (which was directly heated by the induction coil) to the cook-top surface. While the induction stove cook-top will not pose as serious a safety hazard as a traditional electric stove, the residual heating of an induction stove cook-top can be annoying and can, in some cases, cause minor burns.

Also, an induction stove is capable of generating a tremendous amount of heat in a suitable cooking vessel. For example, an induction stove is capable of elevating an empty pot to nearly 1000° F.—a temperature so high that the pot is likely to melt and be destroyed. In order to avoid this situation, many induction stoves include a temperature sensor near where cooking vessels are placed. If the sensor detects a temperature that is above a set limit, the sensor sends a signal to the stove to cut off power to the induction coil, thereby disabling that part of the stove.

Some prior art induction stoves have included features intended to improve the safety and performance of the stoves. For example, U.S. Pat. No. 7,173,224 to Kataoka et al. discloses an induction stove that includes an electrostatic shielding member formed on the top surface of the cook-top. The electrostatic shielding member also includes an insulating layer that is intended to prevent leakage current from harming a user of the stove. However, both the shielding member and the insulating layer protrude above the cook-top and are not removable from the cook-top. These features of the Kataoka stove impede cleaning of the cook-top and are vulnerable to breakage. Also, there is no disclosure of any means to handle or mitigate the heat retained in the cook-top from the cooking vessel. There is also no protection provided against scratching or cracking of the insulating layer or the electrostatic shielding member.

U.S. Pat. No. 7,081,603 to Hoh et al. discloses an induction stove that includes, as an additional heating mechanism, a conventional electrical resistive heating unit. The cook-top includes heat resisting plates in the induction cooking zones, and each plate has planar heating element attached in a groove on the bottom of the plate. There is no disclosure of a means to prevent or mitigate the unsafe indirect heating of the cook-top via the cooking vessel.

What is desired therefore, is an assembly and/or device that will protect the cook-top of an induction stove and that will improve the ease of cleaning of the stove. It is also desired that such an assembly and/or device alleviate the problems associated with the indirect heating of an induction stove cook-top.

SUMMARY OF THE INVENTION

In this regard, the present invention provides induction stove assemblies and devices for use with induction stove assemblies that improve the convenience and safety of cooking with induction heat.

In a first embodiment of the present invention, a cook-top assembly for use with an induction stove is provided. The assembly utilizes a coil to create an oscillating magnetic field that interacts with and generates an amount of heat in a cooking vessel located in an induction cooking zone of the stove. The assembly comprises a cook-top, comprising a substantially horizontal surface and at least one recess formed in the surface, and a pad, placed on the cook-top with at least a portion of the pad disposed in the recess. The portion of the pad disposed in the recess substantially prevents horizontal movement of the pad relative to the cook-top but does not impede removal of the pad from the cook-top.

In some embodiments, the pad causes no more than about a 40% reduction in the amount of heat generated in the cooking vessel by the oscillating magnetic field. In some embodiments, the pad causes no more than about a 20% reduction in the amount of heat generated in the cooking vessel by the oscillating magnetic field. In some embodiments, the pad causes substantially no reduction in the amount of heat generated in the cooking vessel by the oscillating magnetic field.

In some embodiments, the pad exhibits substantially no deformation of shape when exposed to temperatures between 150° F. and 500° F. In some embodiments, the magnetic permeability of the pad is less than $5\times10^{-6}$ μH/m.

In some embodiments, the pad is sized to correspond to the size of the induction cooking zone. In some embodiments, the pad is sized to cover a majority of the surface area of the cook-top. In some embodiments, the pad is formed of a flexible, shock-absorbing material.

In some embodiments, the cook-top further comprises: a top plate, having an opening, and a bottom plate, having an upper surface that is fixed to a lower surface of the top plate and substantially covers the opening. The recess is defined by the space bound by the upper surface of the bottom plate and the opening in the top plate.

In some embodiments, the pad is sized to fit within the recess and rests upon the upper surface of the bottom plate. In some embodiments, the pad includes a protrusion sized to fit within the recess. In some embodiments, the pad is comprised of silicone rubber. In some embodiments, any portions of the pad and the cook-top that are located between the coil and the cooking vessel have a combined thickness of about 10 millimeters or less.

According to another embodiment of the present invention, a pad for use with an induction stove is provided. The induction stove includes a cook-top and a coil for generating an oscillating magnetic field that interacts with and generates an amount of heat in a cooking vessel located in an induction cooking zone. The pad comprises a bottom surface for contacting the cook-top and a top surface for supporting a cooking vessel to be heated. The pad is made of a flexible, shock-absorbing material.

In some embodiments, the pad includes a protrusion for fitting within a recess formed on the cook-top. In some embodiments, the pad is comprised of silicone rubber.

In some embodiments, the pad is sized to substantially correspond to an induction cooking zone of the induction stove and shaped so that when the protrusion is fitted within the recess, the pad is located above the coil. In some embodiments, the pad is sized to substantially correspond to the surface area of the cook-top.

According to yet another embodiment of the present invention, a method of maintaining a plurality of induction stoves, each of which comprises a cook-top, is provided. The method comprises the steps of: providing a set of pads, each of which is adapted to rest on a cook-top; placing a first subset of pads from the set of pads on the cook-tops of the plurality of induction stoves so that users may use the plurality of induction stoves; removing a first pad of the first subset of pads after use of a first induction stove by a first user; placing a second pad taken from a second subset of pads from the set of pads on the cook-top of the first induction stove to replace the first pad so a second user may use the first induction stove; and cleaning the first pad and transferring it to the second subset for subsequent use.

According to still another embodiment of the invention, an induction stove assembly is provided, the assembly comprising: a cook-top, an induction cooking zone above the cook-top, a temperature sensor adjacent the induction cooking zone, and a pad. The pad is adapted to be placed on the cook-top such that its removal from the cook-top is not impeded and adapted to receive a cooking vessel placed in the induction cooking zone. The pad comprises a thermally insulating portion and a thermally transmissive member. The thermally transmissive member is formed from a material having a higher thermal conductivity than a material of which the thermally insulating portion is formed.

In some embodiments, the temperature sensor is disposed beneath the cook-top. In some embodiments, the thermally transmissive member is disposed in the thermally insulating portion such that an uppermost surface of the thermally transmissive member is substantially flush with an uppermost surface of the thermally insulating portion and a lowermost surface of the thermally transmissive member is substantially flush with a lowermost surface of the thermally insulating member. In some embodiments, the thermally transmissive member is comprised of aluminum.

In some embodiments, the thermally transmissive member is composed of a material having a thermal conductivity of 1 W/(m·K) or greater. In some embodiments, the thermally transmissive member is composed of a material having a thermal conductivity of 10 W/(m·K) or greater. In some embodiments, the surface area of the uppermost and lowermost surfaces of the thermally transmissive member are less than 10% of the total surface area of the pad. In some embodiments, the thermally transmissive member comprises a first part and a second part that are secured together by a threaded connection. In some embodiments, the widest portion of the thermally transmissive member has a diameter of about 0.5 inches. In some embodiments, the thermally insulating portion of the pad is formed of silicone rubber. In some embodiments, the pad is sized to substantially correspond to the size of the induction cooking zone.

According to yet another embodiment of the present invention, a pad for use with an induction stove cook-top and for receiving a cooking vessel located in an induction cooking zone is provided. The pad comprises a thermally insulating portion and a thermally transmissive member. The thermally transmissive member is disposed in the thermally insulating portion such that an uppermost surface of the thermally transmissive member is substantially flush with an uppermost surface of the thermally insulating portion and a lowermost surface of the thermally transmissive member is substantially flush with a lowermost surface of the thermally insulating member. The pad is sized to substantially correspond to the size of the induction cooking zone.

In some embodiments, the thermally insulating portion of the pad is made of a flexible, shock-absorbing material. In some embodiments, the thermally insulating portion of the pad is comprised of silicone rubber. In some embodiments, the thermally transmissive member is comprised of aluminum. In some embodiments, the surface area of the top and bottom surfaces of the thermally transmissive member are less than 10% of the total surface area of the pad. In some embodiments, the thermally transmissive member comprises a first part and a second part that are secured together by a threaded connection. In other embodiments, the thermally transmissive member is molded into the thermally insulating portion. In some embodiments, the thermal conductivity of the thermally insulating portion is less than 1 W/(m·K). In some embodiments, the thermal conductivity of the thermally transmissive member is greater than 1 W/(m·K).

According to yet another embodiment of the invention, a method is provided, comprising the steps of: providing a pad for use on an induction stove, wherein said pad comprises a thermally insulating portion and a thermally transmissive member; placing said pad on an induction stove cook-top; placing a cooking vessel on said pad; operating said induction stove such that heat is generated in the cooking vessel; insulating a portion of said cook-top from the heat in the cooking vessel using the thermally insulating portion of the pad; and transmitting heat generated in the cooking vessel to a sensor in the induction stove via said thermally transmissive member.

As used in this specification, the term "induction cooking zone" refers to the volume of space in which a ferromagnetic cooking vessel can be heated by the induction coil of an induction stove.

The invention and its particular features and advantages will become more apparent from the following detailed description considered with reference to the accompanying drawings.

DETAILED DESCRIPTION OF THE INVENTION

Figure 1:
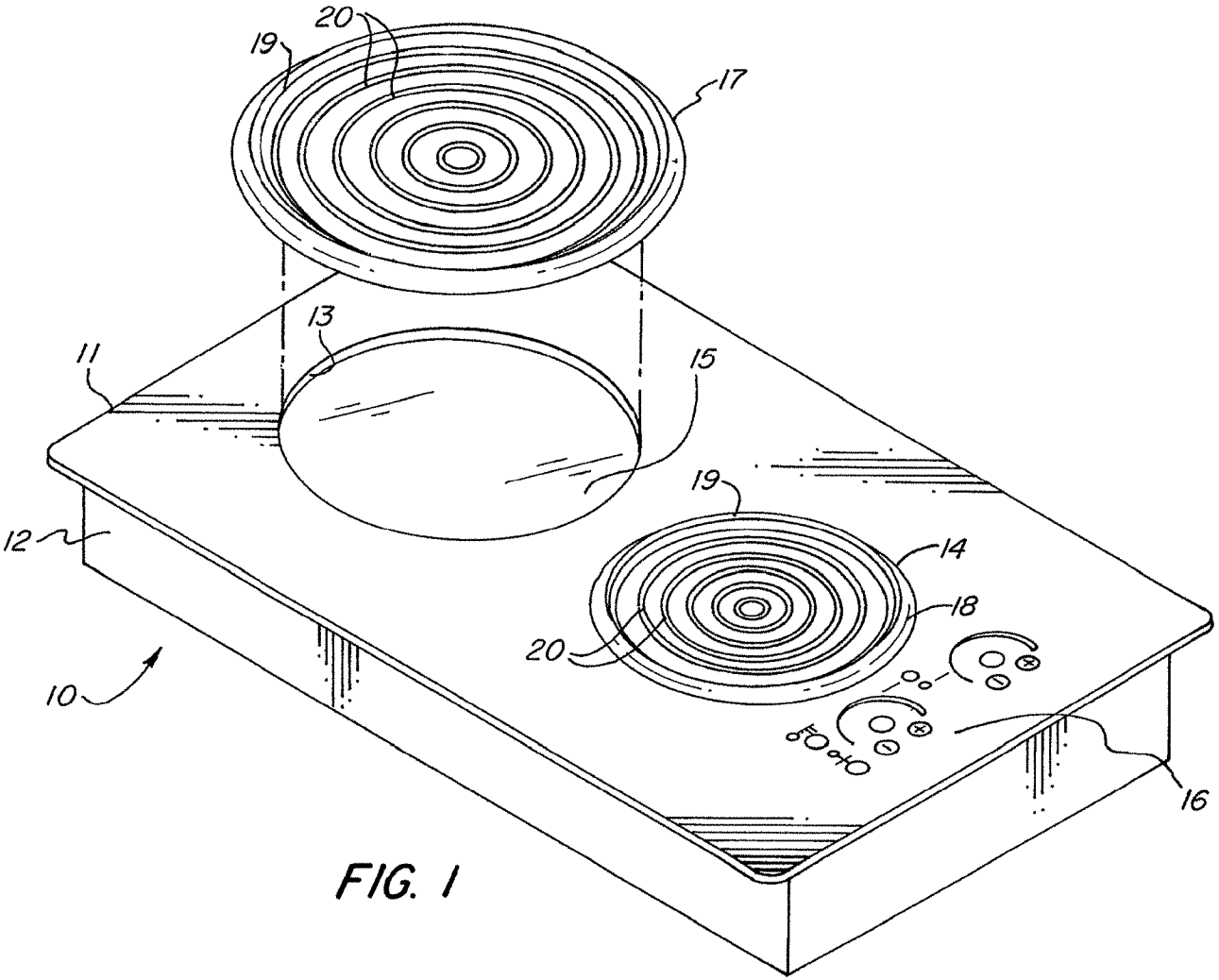
FIG. 1 is a perspective view of an induction stove assembly according to a first embodiment of the present invention.

Referring first to FIG. 1, an induction stove assembly 10 is shown. The assembly 10 includes a cook-top 11 that rests on and is secured to a cabinet 12. The assembly 10 includes two induction cooking zones 13 and 14 which are controlled by the controls 16. Controls 16 include power buttons and temperature selection buttons for each cooking zone. A locking button is also included, which can be used to prevent unwanted use of the assembly 10 by a child.

The induction cooking zones have different sizes—zone 13 is a larger cooking zone than zone 14. The zone 13 has a larger horizontal extent than the zone 14. A larger induction cooking zone is able to heat a large cooking vessel quicker and more evenly than a smaller induction cooking zone would heat that same vessel. Each induction cooking zone has associated with it a recess formed in the cook-top 11. In FIG. 1, only recess 15 corresponding to the induction cooking zone 13 is visible, but the recess corresponding to zone 14 is of a similar design except that it has a smaller diameter. The recesses in the assembly 10 shown in FIG. 1 are circular in order to correspond to the overall shape of the magnetic fields formed in the induction cooking zones.

FIG. 1 also shows two pads 17 and 18. The pads 17 and 18 are each associated with a cooking zone and recess. Each pad 17, 18 includes a protrusion on its underside (not shown in FIG. 1) that fits within its respective recess. As shown in the figures and described below, the recesses in the cook-top and the protrusions on the pads interact to prevent unwanted horizontal (or sliding) movement of the pads with respect to the cook-top. While the pads resist horizontal movement, they are easily removable by vertically lifting the pads off of the cook-top. The pads according to the present invention are not permanently or semi-permanently secured to the cook-top, thus enabling them to be easily removed and replaced with other, similar pads.

The pads 17 and 18, and those described elsewhere in this specification, are designed to receive cooking vessels used with the induction stove assemblies to heat and cook food. The pads of the present invention are designed in a variety of ways to have beneficial features. As shown in FIG. 1, the pads 17 and 18 each include a raised ring 19 near the outer periphery of the pad. The raised ring 19 acts as a guard against spills. For example, if water in a cooking vessel boils over, the water will be contained on the pad instead of allowed to spread over the surface of the cook-top. The raised ring 19 also serves to prevent unwanted horizontal movement of the cooking vessel relative to the cook-top and the cooking zone.

The shape of the pads is varied according to the design of the cook-top, induction stove, and the preferences of the manufacturer and/or end user. The pads 17 and 18 shown in FIG. 1 also include a plurality of raised inner ridges 20, which are in the form of concentric circles. These ridges 20 also help to prevent unwanted horizontal sliding of the cooking vessel relative to the cook-top. The ridges 20 also give provide improved aesthetic appeal to the pads. In other embodiments, other custom designs formed from ridges or recesses are created on the pads, including pictures, logos, graphics, or other personalized or customized designs.

The pads 17 and 18 are designed so that the center portions of the pads, i.e., in the area of the ridges 20, are mostly contained within the circular recesses in the cook-top, while only the raised rings 19 protrude above the cook-top. In other embodiments, such as that shown in FIG. 3, substantially the entire pad is contained within the recess of the cook-top so that the upper surfaces of the pad and cook-top are substantially flush. In still other embodiments, such as those shown in FIGS. 4 and 5 most of the pad material is outside of the recess. In still other embodiments, the cook-top does not include a recess, and the entire pad rests on the top surface of the cook-top.

The pads for use according to the present invention are constructed from a variety of materials. A primary consideration in selection of a material for a pad is that the pad will not interact with the oscillating magnetic field of the induction cooking zones and interfere with the heating of the cooking vessels. Thus, materials having a high magnetic permeability, such as ferrites, nickel, cobalt, etc., are to be avoided. Such materials are also to be avoided for use in the cook-top. It is generally preferred to select materials for the pads having a relatively low magnetic permeability, for example, around $5\times10^{-6}$ μH/m or less. Suitable pads for use in the present invention will, ideally, have a minimal negative impact on the effectiveness of the induction stove in heating a cooking vessel. A suitable pad will reduce the amount of heat generated in a cooking vessel by the oscillating magnetic field of the induction coil by no more than about 40% or less, as compared to the performance of the stove in the absence of the pad. More preferably, the pad will reduce the amount of heat generated in the cooking vessel by the oscillating magnetic field by no more than about 20%. Most preferably, of course, the pad will cause substantially no reduction in the amount of heat generated in the cooking vessel by the oscillating magnetic field.

It is also desirable to design the pad to not deform due to the heat of the cooking vessel. In some embodiments, the pad does not deform when exposed to temperatures between 150° F. and 500° F. In some embodiments, of course, the pad exhibits no deformation when exposed to much higher temperatures. Most induction stoves include a temperature sensor for preventing the stove from heating a pan above a chosen temperature. Such temperature sensors are known in the art, and may be mounted beneath the cook-top of the stove in a manner suitable for the principle of operation of the sensor. One example is a thermocouple mounted to the cook-top directly beneath a cooking zone. By careful selection of the material or materials for use in the pad, a pad according to the present invention can be designed to be used with stoves of virtually any power capability. Pads that do not deform when exposed to temperatures up to 600° F., 700° F., 800° F., 900° F., 1000° F., and above may be used in accordance with the present invention.

In addition to resisting deformation due to high temperatures, some pads used in embodiments of the present invention are used to insulate the cook-top from the heat generated in the cooking vessel. The heat insulating character of such pads helps to prevent the cook-top 11 from becoming undesirably hot. After use of an induction stove with a pad between the cook-top and the cooking vessel, the pads can be removed from the cook-top (using tongs if necessary) and immediately cooled using cold water or stored in a secure place. In some embodiments, depending on the material used to form the pad, removal of the pad may not be necessary because of the rapidity with which the pad cools after the cooking vessel is lifted off of it. In this way, the pads improve the safety of the induction stove.

As described below in reference to FIGS. 7-11, some pads for use in the present invention include features to enable efficient use of temperature sensors in the induction stove that are used to prevent excessive heating of a cooking vessel. Such features include metal heat transmission members arranged in the pads such that the heat generated in the cooking vessel is transmitted to the cook-top and the temperature sensor associated with the induction cooking zone then in use.

Another design consideration for a pad according to the present invention is the ability of the pad to absorb impact and protect the stove cook-top. For example, a material that is soft and resilient will help absorb the impact of a dropped cooking vessel—thereby reducing the likelihood that the cooking vessel will damage the cook-top. Materials that exhibit good impact absorption typically are soft and elastic, even at high temperatures. Such materials are also resilient, in that they will return to shape automatically after being deformed by an external weight.

A material that has a relatively high "surface tack" has also been found to be useful in pads according to the present invention. "Surface tack" helps to prevent a cooking vessel from sliding off of the stove while in use. "Surface tack" refers to the surface of the material having a high coefficient of friction, particularly static friction. Using pads with high surface tack is particularly important with stoves that are to be used in a boat or mobile home.

Finally, it has also been found to be beneficial to make the pads from materials that are resistant to damage that could be caused by cleaning products and/or automatic dishwashers. This enables spills cooking vessels in use to be cleaned up very efficiently, since most spills will be contained on the pad. The pad can simply be lifted off of the cook-top and either cleaned in the sink or placed in a dishwasher for later cleaning. A material that is inert, i.e., non-reactive with most chemicals, is desirable.

While in some embodiments, a pad will possess all of the foregoing desirable traits, it is not necessary for every embodiment. The pads are custom designed for particular applications. For example, an aluminum pad will exhibit very poor impact absorption and surface tack, but will be very resistant to high temperatures and durable. Also, if impact absorption is not a critical design factor and inexpensive production is important, paper specially treated to be resistant to damage from high temperature could be used as a pad. There are uncountable possibilities for pad design. Of course, other materials with varying degrees of suitability in the above-described categories are advantageously employed in embodiments of the present invention.

The inventors have found that heat-insulating silicone rubber is a highly advantageous material for use as a pad in the present invention. Pads made from silicone rubber are relatively easy and inexpensive to fabricate. The material does not interfere significantly with the oscillating magnetic field of the induction stove. The material is soft and flexible but non-reactive with most cleaning agents. It is also a good heat insulator and can be designed not to deform at high temperatures. Silicone rubber can be created in numerous colors, so that the pads can be made to match any kitchen or home décor.

Figure 2:
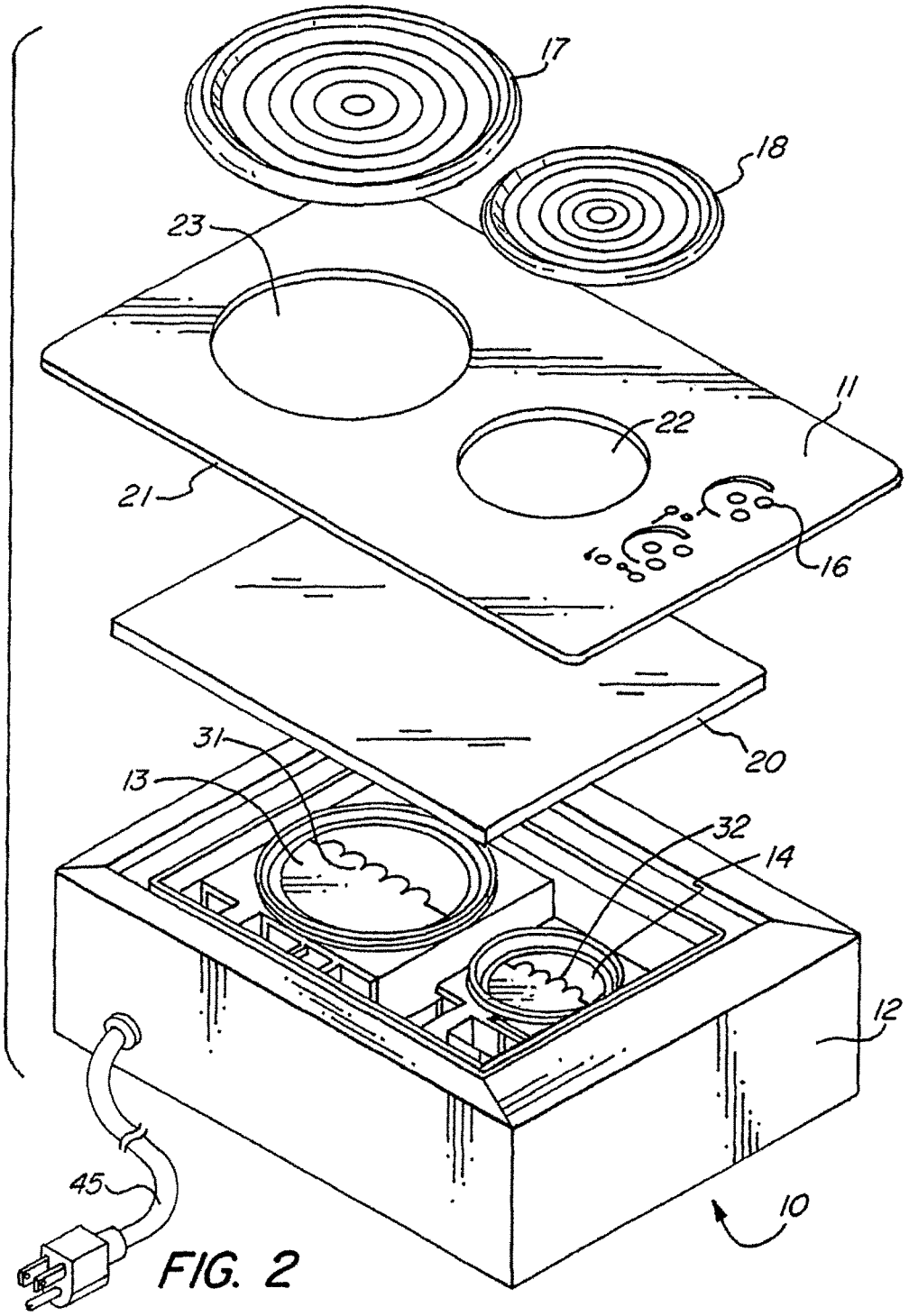
FIG. 2 is a perspective exploded view of the induction stove assembly of FIG. 1.

FIG. 2 shows an exploded view of the components of the inductor stove assembly 10 of FIG. 1. The electronic components used to create the magnetic fields of the induction cooking zones are shown inside the cabinet 12 in a schematic fashion. The areas of the circular induction coils 31 and 32 are represented by the electronic symbol for an inductor.

FIG. 2 also shows the way in which the recesses are formed in the cook-top in this embodiment of the stove assembly 10. In this embodiment, the cook-top 11 comprises a top panel 21 and a bottom panel 20. The top panel 21 has two circular openings 22, 23, which correspond in location to the recesses and induction cooking zones 13 and 14. The top panel 21 is made of any material suitable for an induction stove cook-top, including ceramic, glass, high density thermoplastics, non-ferromagnetic metals (such as aluminum), etc.

Figure 4:
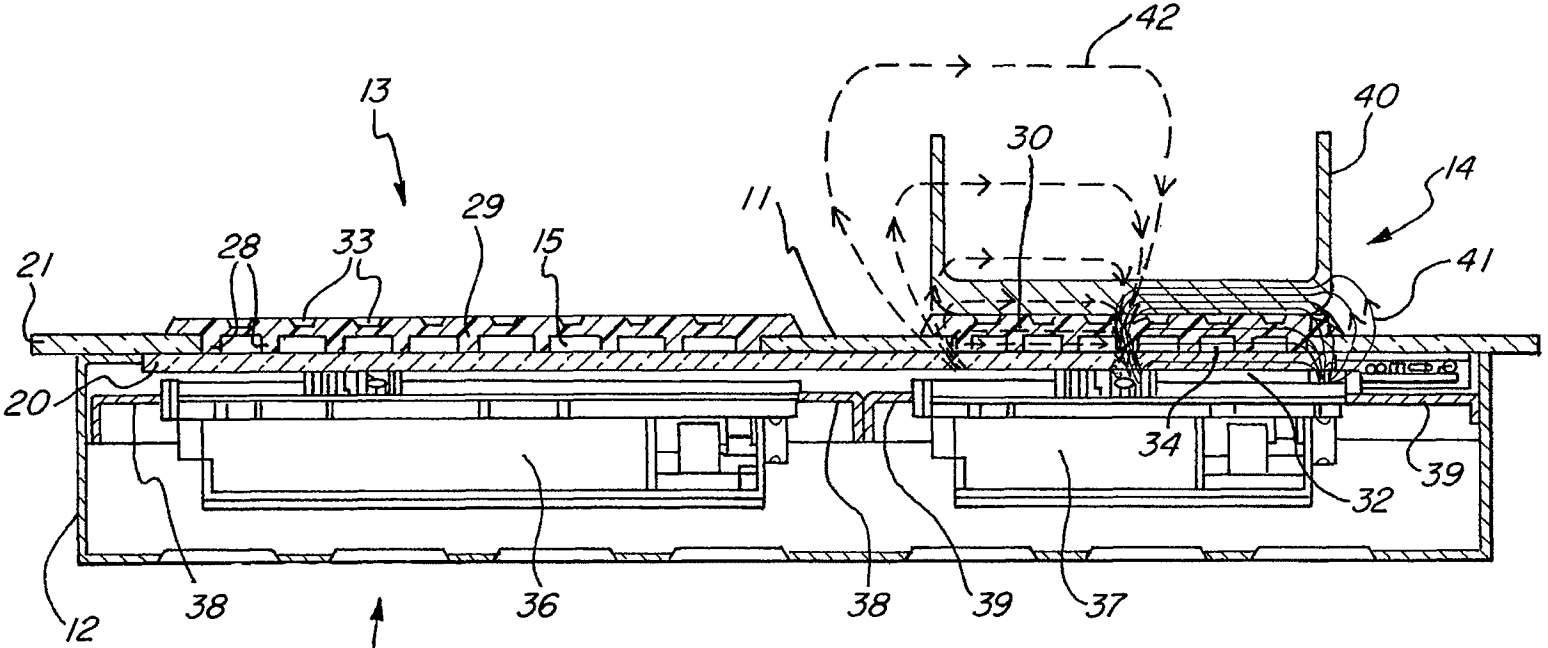
FIG. 4 is a side cross-section view of the induction stove assembly of FIG. 1 using a different type of pad.

In order to create the recesses in the cook-top 11, the bottom panel 20 is secured to the underside of the top panel 21. Generally, the bottom panel 20 is made of the same material used for the top panel 21, but the panels may be of different materials so long as they are suitable for use as an induction stove cook-top. The bottom panel 20 is secured in a permanent or semi-permanent fashion to the top panel 21, by use of adhesives or any other means for joining ceramics, glasses, or other suitable materials. The recesses are thus formed as the space created by the circular openings 22 and 23 and the top surface of the bottom panel 20. This arrangement is also shown in FIG. 4. It has been found that ceramic glass is advantageously used for both the top panel and the bottom panel.

In some embodiments, the stove assembly of the present invention is portable. The stove assembly 10 shown in FIG. 2, for example, is a self-contained unit that, after assembly is completed at the factory, can be moved from place to place and used in various places with ease. The assembly 10 includes a standard 3-prong electrical plug 45 so that the assembly can be placed on a counter top, plugged into a standard household electrical outlet and used. After use, the assembly can be unplugged and moved to storage in an out-of-the-way place or moved to a different location for later use. For ease of portability, the cabinet 12 of the portable stove assembly is provided with one or more handles in some embodiments and the cabinet is made of a durable and sturdy material to withstand frequent handling and moving. In some embodiments, the cabinet has stabilizing feet or spacers on which the portable stove assembly rests while in an upright position. In some embodiments, the portable stove assembly 10 includes a lid for protecting the cook-top during transit. Such a lid is connected by hinges in some embodiments, or is completely removable in other embodiments. In other embodiments, the electrical plug is designed for use in a car or boat electrical system, such as a system that includes a 12-volt plug.

Figure 3:
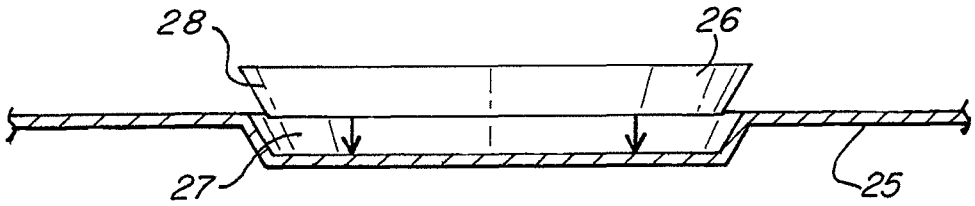
FIG. 3 is a side, cross-section view of an induction cook-top and a pad.

The recesses are formed in other ways in other embodiments. For example, as shown in FIG. 3, the cook-top 25 is a single panel having a recess 27 formed by an indentation made in the panel. The recess 27 is sized and shaped to correspond to the size and shape of the underside of the pad 26. The pad 26 is dropped vertically into the recess 27, and the recess 27 prevents the pad from moving horizontally with respect to the cook-top 25. In the embodiment shown in FIG. 3, the pad 26 is almost completely contained in the recess so that the upper surfaces of the pad and the cook-top are substantially flush. Many embodiments of the present invention employ this design arrangement.

FIG. 4 provides a detailed cross-section view of the induction stove assembly 10 of FIG. 1, but with a set of differently designed pads 29 and 30. In FIG. 4, the pads 29 and 30 do not have a raised ring around their circumference, but have a plurality of concentric, circular recesses or channels 33 for gripping the bottom of a cooking vessel. The protrusions 28 on the underside of the pads 29 and 30 fit within the recesses 15 and 34, with the outermost protrusions 28 being disposed against the edges of the recesses 15 and 34.

FIG. 4 shows clearly the way in which the recesses 15 and 34 are formed in this embodiment of the cook-top 11. The recesses 15 and 34 comprise the space created by the circular openings in the top panel 21 and bound by the upper surface of the bottom panel 20. The recesses are disposed directly in the induction cooking zones 13 and 14, which are created by the induction coils 31 and 32, shown in profile in FIG. 4. The coils 31 and 32 are made of copper tubing or wire and are mounted at a specific distance below the cook-top 11. Below the coils 31 and 32 are the electronics assemblies 36 and 37 connected to the coils. The electronics assemblies 36 and 37 receive control commands from the controls 16 and modulate the performance of the induction stove accordingly. In a typical induction stove, the electronics assemblies include a sensor for monitoring the temperature of the cook-top and adjusting the power output of the coil accordingly. The coils 31 and 32 and electronics assemblies 36 and 37 are supported by frames 38 and 39, respectively, mounted within the cabinet 12.

The function of the electronic components of the induction stove to generate heat in an appropriate cooking vessel is well known in the art. When one desires to heat food in a cooking vessel, the vessel is placed on one of the pads 29 or 30, depending on the size of the cooking vessel and the desired heating power. The user then powers the system and selects a temperature setting using the controls 16. If, for example, the user is using cooking zone 14, alternating current in sent through the coil 32 via the electronics assemblies 37. This causes the coil 32 to produce an oscillating magnetic field that interacts with the cooking vessel 40 placed on the pad 30. If the cooking vessel is ferromagnetic, it will heat up in accordance with the selected temperature setting. Shown in FIG. 4 are the magnetic field lines 41 interacting with the cooking vessel 40. These field lines 41 are shown in solid lines. For comparison, magnetic field lines 42 show the approximate shape of the magnetic field if the cooking vessel 40 were not on the pad 30. These are shown as broken lines. In actuality, the magnetic field created by the coil 32 would look like the lines 41 on both sides of the cooking vessel 40 when the cooking vessel is in place on the pad 30. Conversely, if the coil 30 was switched on without the cooking vessel 40 in place, the field lines on both sides of the zone 14 would all look like the broken lines 42.

In order for any induction stove assembly to function effectively, the separation between the bottom of a cooking vessel and the induction coils must be maintained within the limits of that particular assembly. In the embodiments shown in the FIGs., the induction coils function most effectively when the bottom of the cooking vessel is less than 10 millimeters away. Thus, the combined thicknesses of the portions of the cook-top and the pad that are between the coil and the cooking vessel must be carefully chosen. In other embodiments which utilize differently designed and/or more powerful coils, this distance can be increased. Induction coils capable of heating cooking vessels at much greater distances are known in the art and are used in other embodiments of the present invention.

Figure 5:
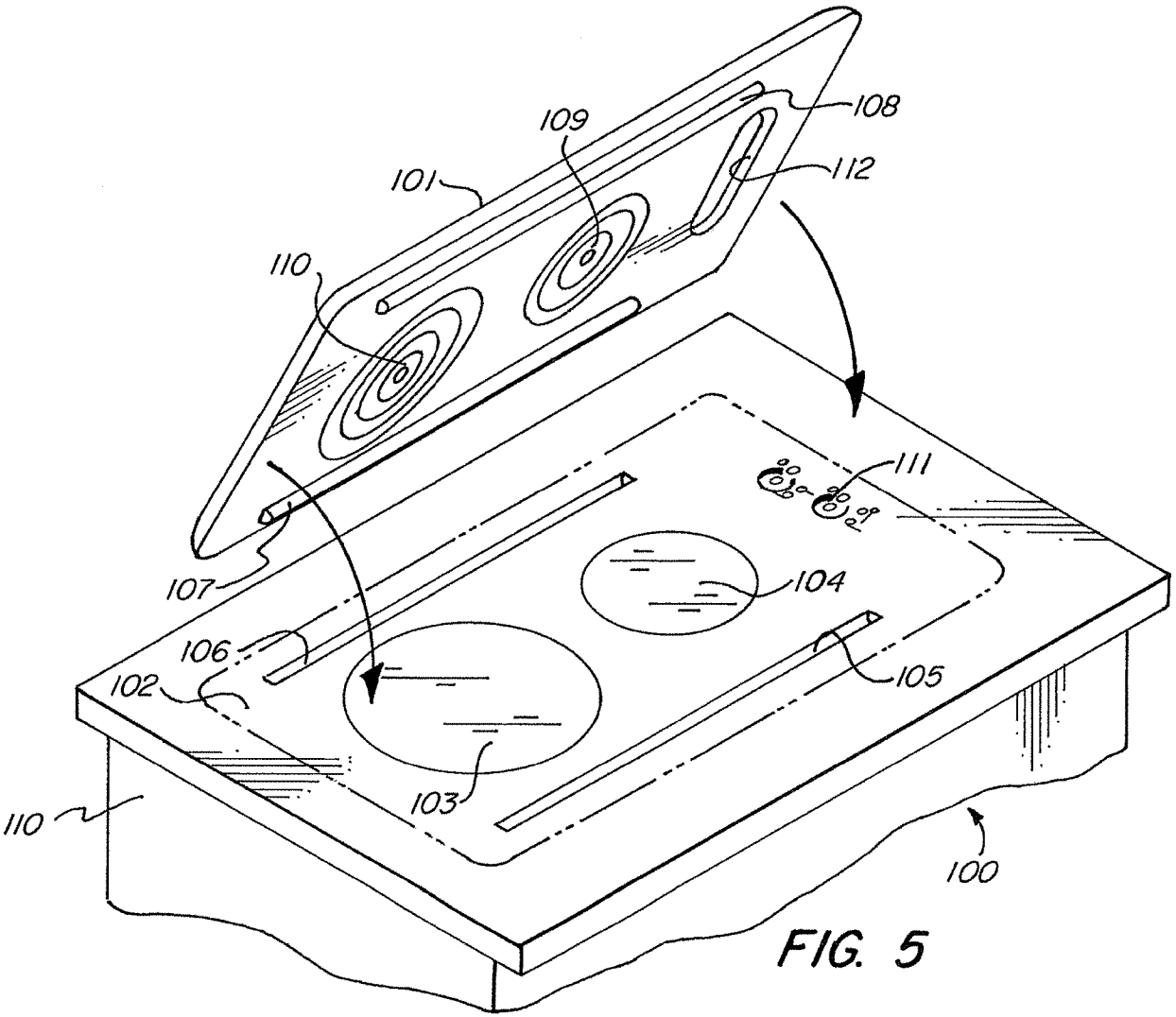
FIG. 5 is a perspective view of an induction stove assembly according to a second embodiment of the invention.

FIG. 5 shows an induction stove assembly 100 that is a second embodiment of the present invention. The assembly 100 again includes a cabinet 110 that houses the electronic components of the stove and on which the cook-top 102 rests. In the assembly 100, however, the two induction cooking zones 103 and 104 do not have associated recesses. Rather, the cook-top 102 is smooth and continuous in the regions of the cooking zones 103 and 104. The cook-top 102 shown in FIG. 5 includes two channels 105 and 106 that run along the long dimension of the cook-top 102. These channels function in a similar fashion as the recesses 15 and 34 of the first embodiment.

Instead of two circular pads that are roughly the same size as the induction cooking zones, the embodiment shown in FIG. 5 has one, relatively large pad 101 that covers substantially the entire surface of the cook-top 102. On its underside, the pad 101 has two ridges 107 and 108, which run along the pad's long edges. The ridges 107 and 108 are sized and shaped to fit snugly within the channels 105 and 106. This arrangement prevents the pad 101 from sliding horizontally relative to the cook-top 102, but enables the pad to be quickly and easily lifted off of the stove for cleaning or replacement. The pad 101 also includes an opening 112 through which the stove controls 111 are accessible when the pad 101 is in position on the cook-top 102. Two designs 109 and 110 are formed or printed on the pad 101 so that a user of the stove assembly 100 will know where the induction cooking zones 103 and 104 are located when the pad 101 is in position.

The use of the large pad 101 with the second embodiment, has the advantage of providing the entire cook-top surface with protection while the stove is in use. Clearly, a dropped cast iron cooking vessel could damage the ceramic glass cook-top even if the vessel was dropped somewhere other than in the induction cooking zones. The large pad 101 helps prevent such damage since it covers substantially the entire cook-top 102 when it is in position.

Figure 6:
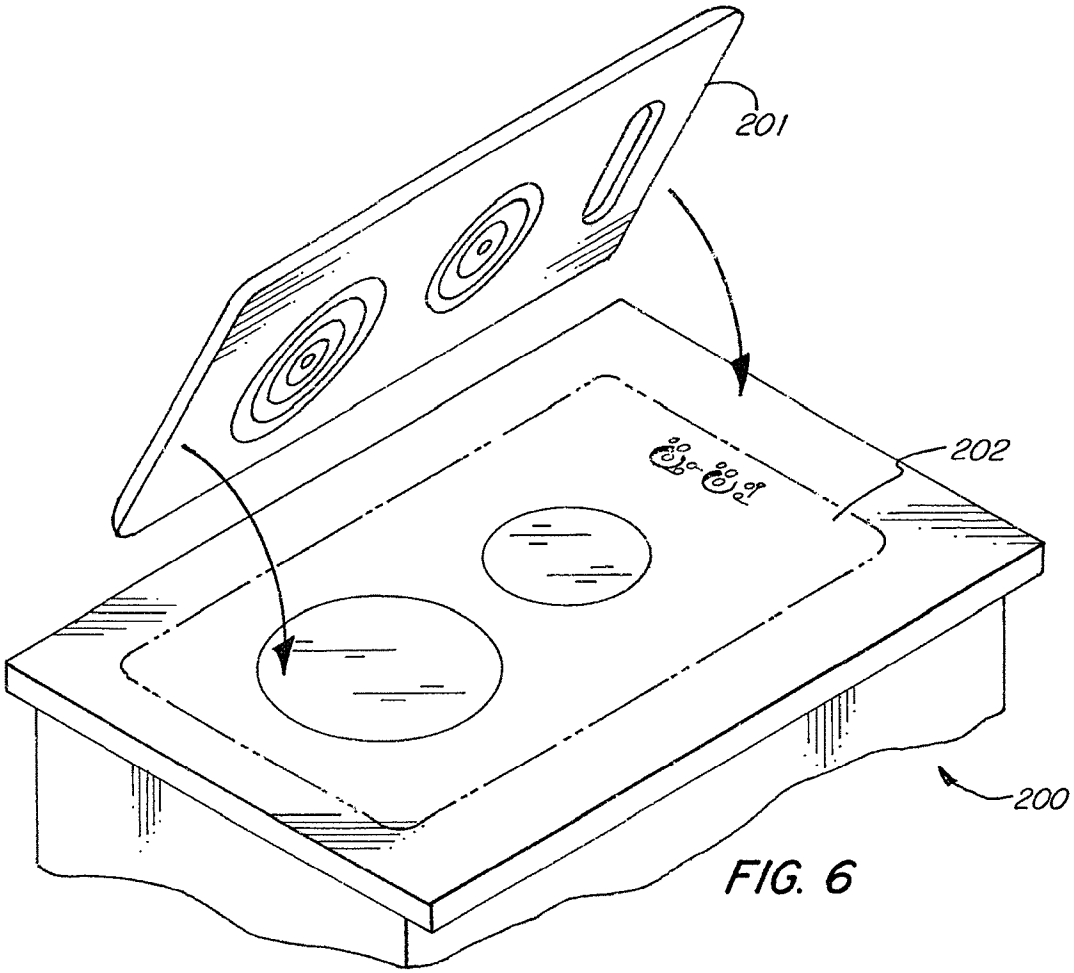
FIG. 6 is a perspective view of an induction stove assembly according to a third embodiment of the invention.

FIG. 6 shows an embodiment of an induction stove assembly 200 similar to that of FIG. 5, except that the pad 201 does not have protrusions and the cook-top 202 does not have recesses. The pad 201 is formed of a flexible, impact-absorbing material to protect the cook-top 202. In some embodiments, multiple circular pads such as those shown in other FIGs. are used with a smooth, recess-free cook-top 202.

Figure 7:
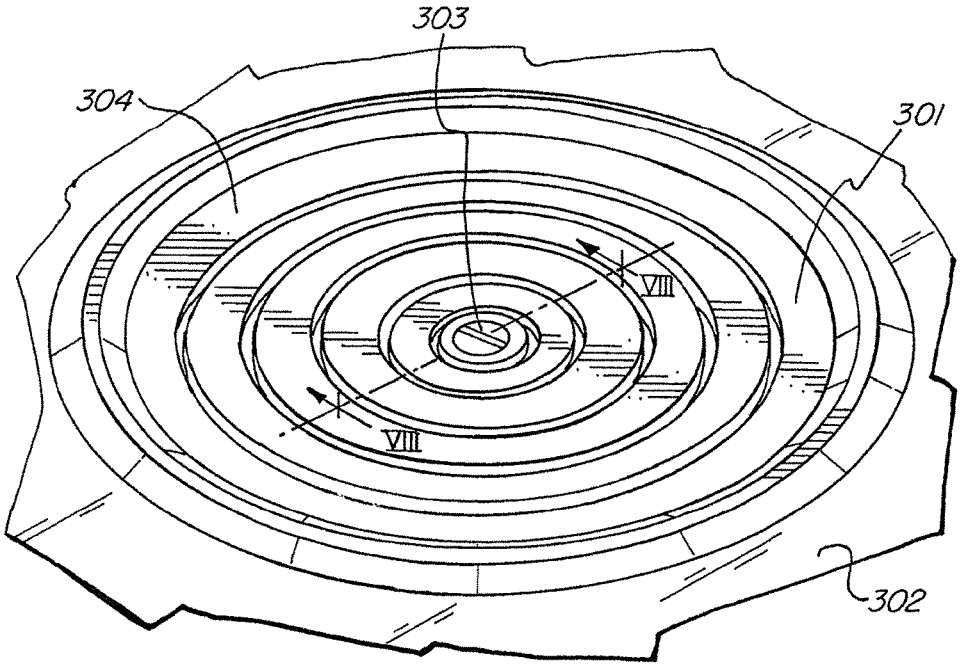
FIG. 7 is a perspective view of another embodiment of the invention.

FIG. 7 shows a perspective view of another embodiment of the present invention. A pad 301 is shown disposed on a cook-top 302. The cook-top 302 is shown in cutaway, but is a part of an induction stove similar to that shown in FIG. 1. The pad 301 includes a thermally insulating portion 304 and a thermally transmissive member 303. The member 303 is used to transmit heat generated in a cooking vessel that is placed on the pad 301 to a temperature sensor located in the induction stove.

Figure 8:
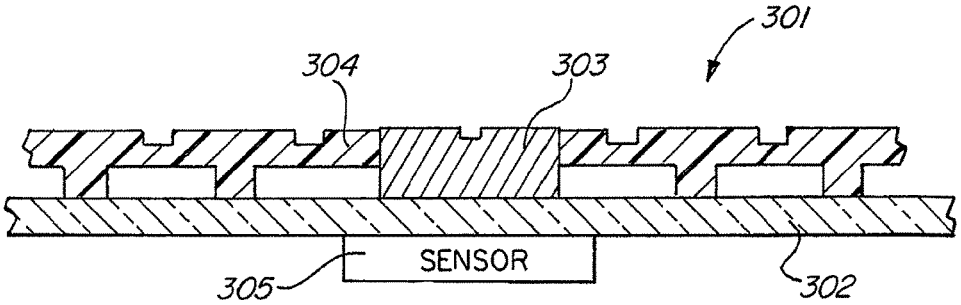
FIG. 8 is a cross-section view of the embodiment shown in FIG. 7.

FIG. 8 is a cross-section view of the arrangement shown in FIG. 7. The line VIII in FIG. 7 shows the location of the cross-section. The member 303 and the thermally insulating portion 304 both have a bottom surface that contacts the cook-top 302 and both have a top surface that contacts a cooking vessel that is placed on the pad 301. In other words, the uppermost surface of the member 303 is substantially flush with the uppermost surface of the portion 304, and the lowermost surface of the member 303 is substantially flush with the lowermost surface of the portion 304. As a result, when the cooking vessel is heated via interaction with the induction coil in the stove, heat is transmitted from the vessel to the cook-top 302 via the member 303. A temperature sensor 305—shown schematically—is disposed beneath the cook-top 302 and senses the change in temperature of the cook-top 302. If the temperature sensor detects a temperature above a safe level (or above a level set by the user or manufacturer), the sensor will send a signal to disable the induction coil associated with that cooking zone. In short, the member 303 transmits heat from the cooking vessel to the sensor.

The member 303 may be permanently mounted in the thermally insulating portion 304 of the pad 301, or it may be removably mounted in the portion 304, depending on the embodiment. In the embodiment shown in FIG. 8, the member 303 is permanently mounted in the center of the pad 301. Permanent mounting can be achieved by, as examples, heat-resistant adhesive or by molding the material of the insulating portion 304 around the member 303 so that it is permanently held there.

Figure 9:
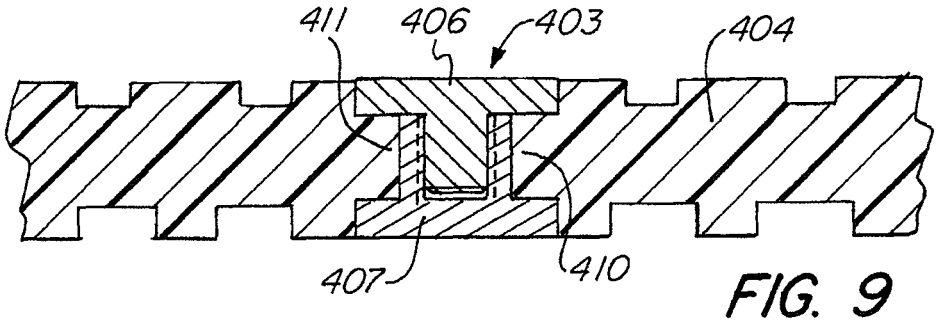
FIG. 9 is a cross-section view of another embodiment of the invention.
Figure 10:
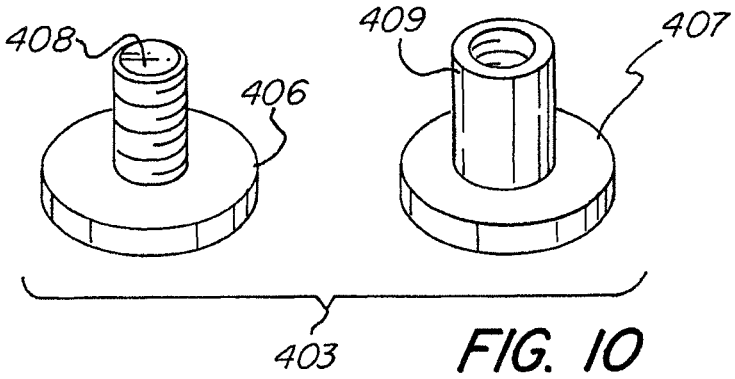
FIG. 10 is a perspective view of the thermally transmissive member shown in FIG. 9.

FIGS. 9 and 10 show another embodiment of the invention in which the thermally transmissive member 403 comprises a first part 406 and a second part 407. The first part 406 has a threaded portion 408 with external threads that corresponds to the threaded portion 409 on the second part 407 and having internal threads. As shown in FIG. 9, the parts 406 and 407 are threaded together on a thermally insulating portion 404 in a clamping fashion, with portions 410 and 411 of the thermally insulating portion 404 pressed between the parts 406 and 407 when these parts are tightened together.

In other embodiments the member 403 is removably mounted in the pad using an interference or friction fit, as examples. Designs in which the member is removable from the pad permit separate cleaning of the thermally insulating portion and the member.

Figure 11:
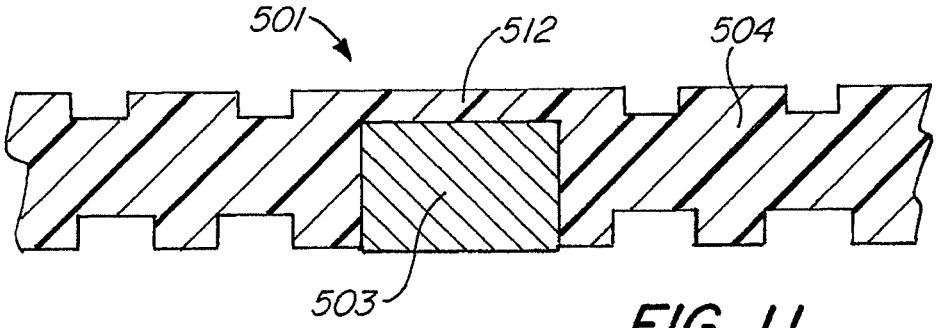
FIG. 11 is a cross-section view of another embodiment of the invention.

FIG. 11 shows still another embodiment of the present invention. Thermally transmissive member 503 is mounted in pad 501 in the thermally insulating portion 504. In this embodiment, the member 503 does not have exposed surfaces on both the top and bottom of the pad 501. Instead, the bottom surface of the member 503 is in contact with the cook-top while a thin covering portion 512 of the thermally insulating portion 504 covers the top surface of the member 503. In this embodiment, the temperature sensor would possibly require tuning to respond to a lower temperature because of the insulating nature of the thin covering 512. In this embodiment, the heat from the cooking vessel travels through the thin covering 512, the member 503, and to the cook-top where it is detected by the temperature sensor.

In most embodiments, the thermally transmissive member is mounted in the center of the pad, both of which are generally circular. The critical aspect of the location of the thermally transmissive member, however, is that it is aligned over the temperature sensor in the stove. Thus, the pad is designed to ensure this alignment when placed on the cook-top. A circular pad achieves this simply, but other pad designs are possible, such as oval, square, or rectangular.

The thermally transmissive members 303, 403, and 503 for use with the present invention are generally made from a material having a thermal conductivity of greater than 1 W/(m·K). A thermal conductivity of greater than 10 W/(m·K) is preferable, greater than 100 W/(m·K) is more preferable, and greater than 200 W/(m·K) is even more preferable. In general, the higher the thermal conductivity of the material used, the more efficiently the thermally transmissive member will work. Thus, any material that will maximize heat transmission is preferred. In one advantageous embodiment, the thermally transmissive member is comprised of aluminum. In other embodiments, copper, brass, and other metals are used. Most preferably, non-ferromagnetic materials are used for the thermally transmissive member, so as to avoid additional heat generated in the member by induction generated by the induction stove's coil. Ferromagnetic materials are used for the thermally transmissive member in some embodiments, however, and, in some cases, the temperature sensor of the stove is tuned to accommodate additional heat due to interaction of the member with the induction coil.

For the thermally insulating portion 304, 404, and 504, as described above, silicone rubber is an advantageous material choice. However, any suitable insulating material is usable. Materials having a thermal conductivity of less than 1 W/(m·K) are generally preferred.

The thermally transmissive members used in the present invention are often generally cylindrical, however other shapes are used in other embodiments. The shape of the member can be selected for aesthetic purposes and optimized for efficient heat transmission. For example, a broad contact area between the thermally transmissive member and the cook-top and the cooking vessel have been found to make for efficient heat transfer. In general, the exposed areas of the surfaces of the thermally transmissive member comprise less than 20% of the surface area of the pad, preferably less than 15%, more preferably less than 10%, and even more preferably, less than 5%.

All of the different types of pads shown in FIGS. 1-6 and FIGS. 7-11 are advantageously usable with both permanently installed induction stoves and portable stoves.

The unique induction stove assemblies according to the present invention clearly provide many advantages to residential users who cook for themselves and their families at home. However, the present invention also brings numerous advantages in other contexts as well, such as in a hotel or dormitory setting. In a hotel, for example, many substantially similar stoves will be installed in the guest rooms. These stoves will most often need to be cleaned on a daily basis. By utilizing the pads of the present invention, the daily cleaning of the stoves in these rooms can be accomplished in a much more efficient manner.

For example, for a hotel with 100 rooms, each with an induction stove having a single induction cooking zone, the hotel purchases 200 pads. 100 of these pads are placed on the cook-tops of the stoves and form a first subset of the set of 200 pads. When each room is cleaned after use by a guest in the hotel, the pad is removed from the induction stove in that room and replaced with a pad from the 100 reserve pads that form a second subset of the set of 200 pads. (In some embodiments, the pad is only be removed if the stove was actually used). The used pad is then cleaned (along with all other used pads from the first subset) by the hotel staff by hand or using a dish-washing machine. The cleaned pads then become part of the second subset of pads for subsequent use in the hotel rooms. Significant cleaning time is saved because the hotel cleaning staff does not need to scrub each individual stove cook-top that was used. This method is also effective in dormitories or apartment buildings that utilize a central cleaning service.

It should be appreciated by those skilled in the art that various changes and modifications can be made to the illustrated embodiments without departing from the spirit of the present invention. All such modifications and changes are intended to be covered within the scope of the present invention disclosure.

What is claimed is:

1. A pad for use with an induction stove cook-top for receiving a cooking vessel located in an induction cooking zone, comprising:

a thermally insulating portion; and a thermally transmissive member;

wherein the thermally transmissive member is disposed in the thermally insulating portion such that an uppermost surface of the thermally transmissive member is substantially flush with an uppermost surface of the thermally insulating portion and a lowermost surface of the thermally transmissive member is substantially flush with a lower most surface of the thermally insulating portion; wherein the lowermost surface of the thermally transmissive member and the lowermost surface of the thermally insulating portion are adapted to make contact with the cook-top.

2. The pad of claim 1, wherein the thermally insulating portion of the pad is made of a flexible, shock-absorbing material.

3. The pad of claim 2, wherein the thermally insulating portion of the pad is comprised of silicone rubber.

4. The pad of claim 1, wherein the thermally transmissive member is comprised of aluminum.

5. The pad of claim 1, wherein the surface area of the top and bottom surfaces of the thermally transmissive member are less than 10% of the total surface area of the pad.

6. The pad of claim 1, wherein the thermally transmissive member comprises a first part and a second part that are secured together by a threaded connection.

7. The pad of claim 1, wherein the thermal conductivity of the thermally insulating portion is less than 1 W/(m·K).

8. The pad of claim 7, wherein the thermal conductivity of the thermally transmissive member is greater than 1 W/(m·K).

9. A pad for use with an induction stove cook-top for receiving a cooking vessel located in an induction cooking zone, comprising:

a thermally insulating portion; and a thermally transmissive member;

wherein the thermally transmissive member is disposed in the thermally insulating portion such that an uppermost surface of the thermally transmissive member and an uppermost surface of the thermally insulating portion are adapted to make contact with the cooking vessel and wherein a lowermost surface of the thermally transmissive member and a lowermost surface of the thermally insulating portion are adapted to make contact with the cook-top.

10. The pad of claim 9, wherein the thermally insulating portion of the pad is made of a flexible, shock-absorbing material.

11. The pad of claim 10, wherein the thermally insulating portion of the pad is comprised of silicone rubber.

12. The pad of claim 9, wherein the thermally transmissive member is comprised of aluminum.

13. The pad of claim 9, wherein the surface area of the top and bottom surfaces of the thermally transmissive member are less than 10% of the total surface area of the pad.

14. The pad of claim 9, wherein the thermally transmissive member comprises a first part and a second part that are secured together by a threaded connection.

15. The pad of claim 9, wherein the thermal conductivity of the thermally insulating portion is less than 1 W/(m·K).

16. The pad of claim 15, wherein the thermal conductivity of the thermally transmissive member is greater than 1 W/(m·K).

* * * * *